US006003160A

United States Patent [19]

Seidle et al.

[11] Patent Number: 6,003,160

[45] Date of Patent: Dec. 21, 1999

[54] AUTOMATIC SELF-ILLUMINATING TOILET LID

[76] Inventors: James Seidle; Linda Seidle, both of 1141 W. Canal, Peru, Ind. 46970

[21] Appl. No.: 09/294,626

[22] Filed: Apr. 19, 1999

[51] Int. Cl.[6] ..... A47K 3/12

[52] U.S. Cl. ..... 4/234; 4/661; 4/242.1

[58] Field of Search ..... 4/234, 661, 242.1

[56] References Cited

U.S. PATENT DOCUMENTS

| | | | |
|---|---|---|---|
| 4,736,471 | 4/1988 | Johnson | 4/234 |
| 5,036,443 | 7/1991 | Humble et al. | 4/661 |
| 5,276,595 | 1/1994 | Patrie | 4/661 |
| 5,664,867 | 9/1997 | Martin et al. | 4/661 |
| 5,691,705 | 11/1997 | East | 4/661 |

FOREIGN PATENT DOCUMENTS

| | | | |
|---|---|---|---|
| 2681232 A1 | 3/1993 | France | 4/242.1 |
| 5-168571 | 7/1993 | Japan | 4/242.1 |

*Primary Examiner*—Charles R. Eloshway
*Attorney, Agent, or Firm*—Jack Schuman

[57] ABSTRACT

Mounted on a toilet lid is a lamp, a battery, a gravity switch and a light sensor, whereby the lamp is automatically lit in the absence of light when the toilet lid is raised, and is automatically extinguished when the light sensor senses light or when the toilet lid is lowered to rest on the toilet seat.

3 Claims, 2 Drawing Sheets

AUTOMATIC SELF-ILLUMINATING TOILET LID

BACKGROUND OF THE INVENTION

1. Field of the Invention

This invention relates to an automatic self-illuminating toilet lid.

2. Description of the Prior Art

Toilet lids are almost universally known. However, toilet lids that embody a light source which can automatically be switched on when the toilet lid is raised, and which is automatically switched off when the toilet lid is lowered on to the toilet seat, are not known.

SUMMARY OF THE INVENTION

One of the objects of this invention is to provide a toilet lid embodying a light source which can automatically be switched on when the toilet lid is raised and which is automatically switched off when the toilet lid is lowered on to the toilet seat.

Other and further objects of this invention will become apparent by reference to the accompanying specification and drawings and to the appended claims.

Briefly, we have discovered that the foregoing objects may be attained by installing in a cavity in the toilet lid a source of light, a source of power, and a gravity switch which is off when the toilet lid is horizontal (i.e., resting on the toilet seat) and on when the toilet lid is raised.

DESCRIPTION OF THE DRAWINGS

Referring now to the drawings, in which like numerals represent like parts in the several views.

DESCRIPTION OF THE PREFERRED EMBODIMENT

Figure 2:
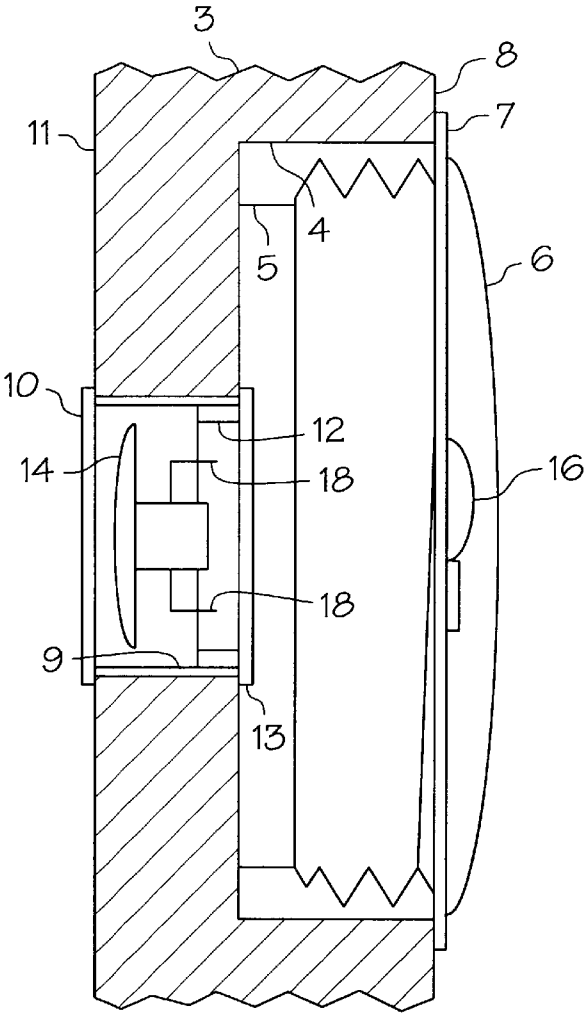
FIG. 2 represents an enlarged partially diagrammatic transverse vertical section of the toilet lid showing the apparatus of the present invention housed in a cavity in the toilet lid.
Figure 1:
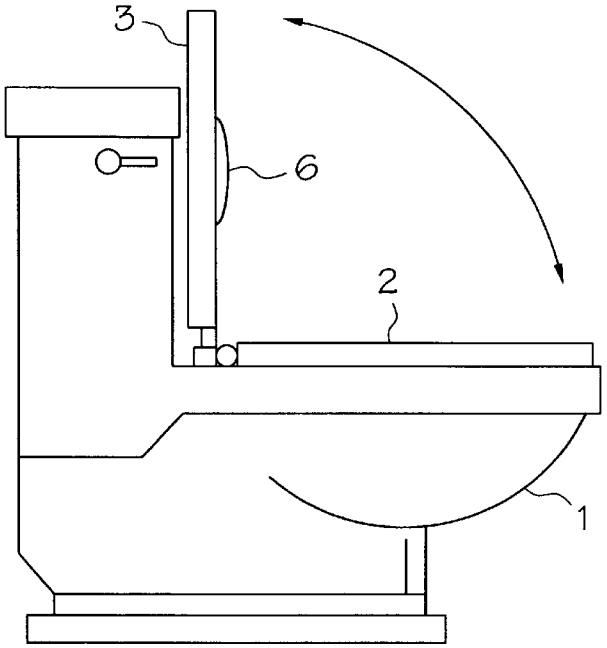
FIG. 1 represents a side elevation of a conventional toilet showing diagrammatically by an arrow the pivotal or hinged movement of the toilet lid from a horizontal position on the toilet seat to a vertical position uncovering the toilet seat.

Toilet 1 is provided with toilet seat 2 and toilet lid 3.

Toilet lid 3 is provided with cavity 4 in which is mounted housing 5 receiving threaded clear plastic lens 6.

Plastic lens 6 has a flange 7 which bears against the bottom face 8 of toilet lid 3.

Clear plastic collar 9 likewise is mounted within cavity 4 extending through toilet lid 3, and is provided with flange 10 which bears against the top face 11 of toilet lid 3.

Cylindrical coupler 12 is threaded into collar 9, and has flange 13 which securely holds collar 9 in position.

Light sensor 14 is mounted within clear plastic collar 9.

Figure 4:
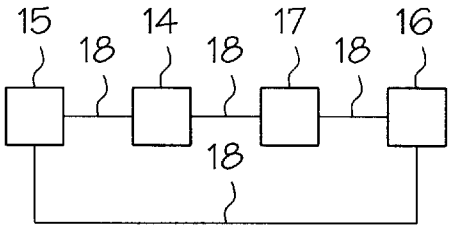
FIG. 4 is a diagram of the electrical circuitry embodied in the present invention.

Mounted within housing 5 are batteries 15, lamp 16, gravity switch 17, and wiring 18 connecting in series light sensor 14, batteries 15, lamp 16 and gravity switch 17. FIG. 4 shows the circuit diagram for this series connection.

Light sensor 14 is selected so as to open the series circuit when room light or daylight is detected, regardless of the position of gravity switch 17, thus preventing batteries 15 from lighting lamp 16, and to close the series circuit when neither room light nor daylight is detected, thus permitting gravity switch 17 to determine when lamp 16 is to be lit.

Figure 5:
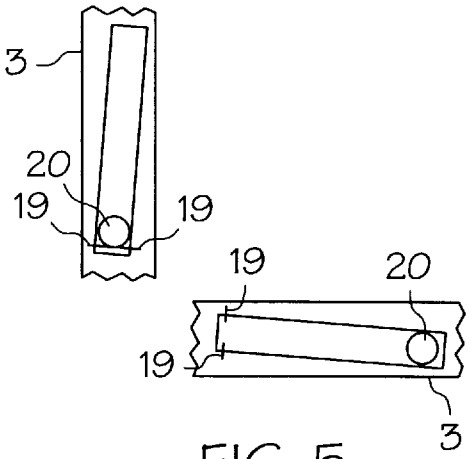
FIG. 5 represents diagrammatically and not to scale a portion of the gravity switch in a position slightly inclined to the horizontal, corresponding to the toilet lid resting on the toilet seat, with the connecting ball in circuit-open position, and also shows diagrammatically and not to scale a portion of the gravity switch in vertical position, corresponding to the toilet lid being raised, with the connecting ball in circuit-closed position.
Figure 3:
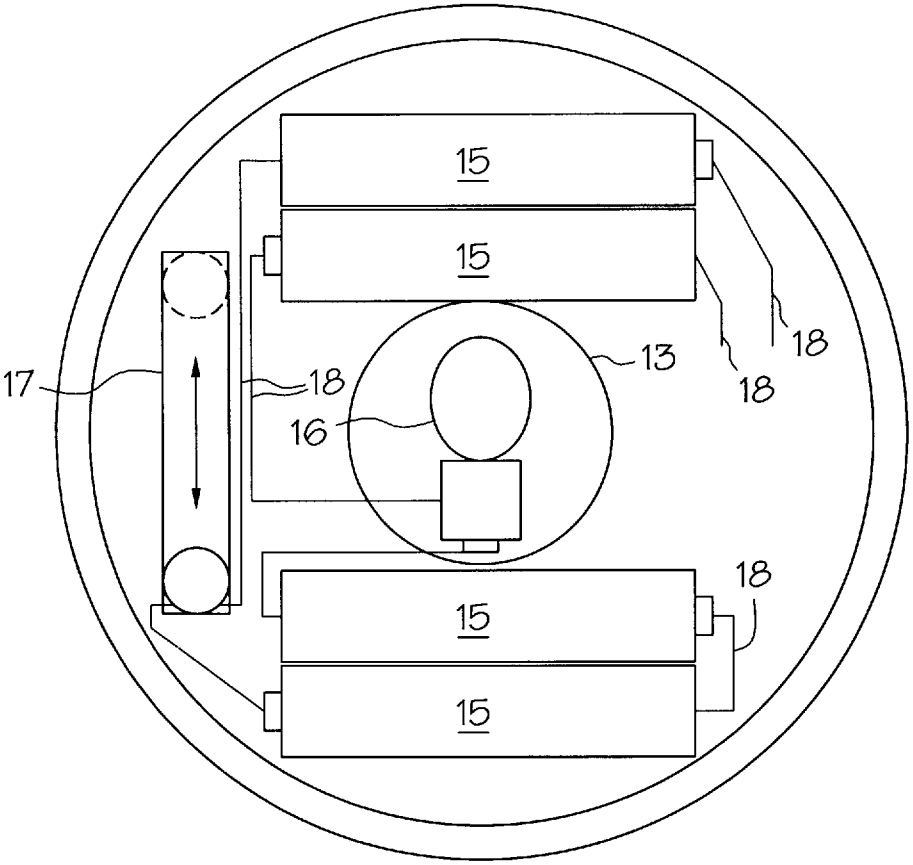
FIG. 3 represents an enlarged front elevation of the housing for the apparatus of the present invention, showing the connecting ball of the gravity switch in circuit-closing position when the toilet lid is raised, and showing diagrammatically by arrows the direction of travel of the connecting ball(shown in dotted lines) in the housing of the gravity switch to a circuit-open position when the toilet lid is lowered to rest on the toilet seat.

As shown diagrammatically in FIG. 5, gravity switch 17 is preferably mounted at a slight angle to the horizontal as viewed with toilet lid 3 resting on toilet seat 2 in a horizontal position, the elevated portion of gravity switch 17 having the contact points 19, thus insuring that metallic connecting ball 20 has rolled to the lower end of gravity switch 17 leaving open the series circuit.

Further, as shown diagrammatically in FIG. 5, when toilet lid 3 is raised to the vertical position, metallic connecting ball 20 rolls down to engage contact points 19, thereby to close the series circuit.

The operation of toilet lid 3 embodying the present invention should be readily apparent from the foregoing description.

There are a number of advantages accruing from the use of the present invention.

Because toilet lid 3 is automatically self-illuminating there is no need to turn on the bathroom light when using toilet 1.

The present invention reminds men to lower toilet seat 3 after urination. It will be apparent that toilet seat 2 must be down before toilet lid 3 is lowered on to toilet seat 2, thereby to extinguish lamp 16.

Use of the present invention is totally independent of household power source, and therefore totally independent of power outages, because it is completely battery operated.

The present invention can be installed in the toilet lid of a "potty chair" for toddlers, and could encourage "potty training".

Light sensor 14 is optional, and may be eliminated from the circuitry. However, if incorporated in the circuitry, it will conserve battery life by disabling or opening the circuit when toilet 1 receives daylight or sufficient room light.

The foregoing description is illustrative of the principles of our invention. Further, since numerous modifications and changes may readily occur to those skilled in the art to which this invention pertains, the invention should not be limited to the exact apparatus shown and described herein, and the appended claims should be construed as covering suitable modifications and equivalents.

We claim:

1. Automatic self-illuminating apparatus for use in covering the toilet seat of a toilet, said apparatus comprising:

(a) a toilet lid adapted to be hingedly mounted to said toilet and adapted to be rotated between a horizontal position covering said toilet seat and a vertical position uncovering said toilet seat, said toilet lid having a cavity, a bottom face adapted to rest on said toilet seat, and a top face opposite said bottom face, (b) a lamp mounted to said toilet lid, (c) a battery mounted to said toilet lid, (d) a gravity switch mounted to said toilet lid, (e) electrical circuitry connecting in series said lamp, said battery, and said gravity switch, said gravity switch opening said electrical circuitry when said toilet lid is in the horizontal position resting on said toilet seat, and closing said electrical circuitry when said toilet lid is raised from said horizontal position, (f) light sensing means mounted to said toilet lid and incorporated in series in said electrical circuitry, said light sensing means opening said electrical circuitry when light is sensed and closing said electrical circuitry in the absence of light, (g) said battery, said gravity switch, and said lamp being housed in said cavity, with said lamp being exposed through the bottom face of said toilet lid and said light sensing means being exposed through the top face of said toilet lid, whereby when light is sensed by said light sensing means, said electrical circuitry is opened and said lamp will not be illuminated regardless of the position of the toilet lid, and when light is not sensed, said electrical circuitry is closed, such that said gravity switch is operable to close said electrical circuitry and illuminate said lamp when the toilet lid is raised from the horizontal position.

2. Apparatus as in claim 1, said gravity switch comprising:

(h) a tube having a longitudinal axis and mounted to said toilet lid with said longitudinal axis disposed at an angle to the horizontal when said toilet lid is resting horizontally on said toilet seat, said tube having a first end and a second end, said first end being elevated above said second end when said toilet lid is resting horizontally on said toilet seat, (i) a pair of spaced electrical contact points incorporated in series in said electrical circuitry and extending into said first end of said tube, (j) an electrically conductive connecting ball positioned in said tube and adapted to roll between said first and second ends of said tube, (k) whereby, when said toilet lid is resting horizontally on said toilet seat, said connecting ball has rolled to a position adjacent said second end of said tube leaving said electrical circuitry in open position, (l) and whereby, when said toilet lid is raised from horizontal position, said connecting ball rolls to said first end of said tube to engage said contact points to closed said electrical circuitry.

3. Automatic self-illuminating apparatus for use in covering the toilet seat of a toilet, said apparatus comprising:

(a) a toilet lid adapted to be hingedly mounted to said toilet and adapted to be rotated between a horizontal position covering said toilet seat and a vertical position uncovering said toilet seat, said toilet lid having a cavity, a bottom face adapted to rest on said toilet seat, and a top face opposite said bottom face, (b) a lamp mounted to said toilet lid, (c) a battery mounted to said toilet lid, (d) electrical circuitry connecting in series said lamp, said battery, and a gravity switch mounted to said toilet lid, said gravity switch opening said electrical circuitry when said toilet lid is in the horizontal position resting on said toilet seat, and closing said electrical circuitry when said toilet lid is raised from said horizontal position, said gravity switch comprising:

(1) a tube having a longitudinal axis and mounted to said toilet lid with said longitudinal axis disposed at an angle to the horizontal when said toilet lid is resting horizontally on said toilet seat, said tube having a first end and a second end, said first end being elevated above said second end when said toilet lid is resting horizontally on said toilet seat, (2) a pair of spaced electrical contact points incorporated in series in said electrical circuitry and extending into said first end of said tube, (3) an electrically conductive connecting ball positioned in said tube and adapted to roll between said first and second ends of said tube, whereby when said toilet lid is resting horizontally on said toilet seat, said connecting ball has rolled to a position adjacent said second end of said tube leaving said electrical circuitry in the open position, and when said toilet lid is raised from the horizontal position, said connecting ball rolls to said first end of said tube to engage said contact points to close said electrical circuitry, (f) light sensing means mounted to said toilet lid and incorporated in series in said electrical circuitry, said light sensing means opening said electrical circuitry when light is sensed and closing said electrical circuitry in the absence of light, (g) said battery, said gravity switch, and said lamp being housed in said cavity, with said lamp being exposed through the bottom face of said toilet lid and said light sensing means being exposed through the top face of said toilet lid, whereby when light is sensed by said light sensing means, said electrical circuitry is opened and said lamp will not be illuminated regardless of the position of the toilet lid, and when light is not sensed, said electrical circuitry is closed, such that said gravity switch is operable to close said electrical circuitry and illuminate said lamp when the toilet lid is raised from the horizontal position.

* * * * *